United States Patent [19]

Hardin et al.

[11] 4,423,589

[45] Jan. 3, 1984

[54] TELECOMMUNICATION CABLES AND METHODS OF MANUFACTURING SAME

[75] Inventors: Tommy G. Hardin, Lilburn; Bruce C. Vrieland, Norcross, both of Ga.

[73] Assignee: Western Electric Company, Inc., New York, N.Y.

[21] Appl. No.: 230,233

[22] Filed: Feb. 2, 1981

[51] Int. Cl.[3] ..... H01B 13/04; D07B 3/00

[52] U.S. Cl. ..... 57/293

[58] Field of Search ..... 57/3, 9, 204, 293

[56] References Cited

U.S. PATENT DOCUMENTS

| | | | |
|---|---|---|---|
| 2,258,687 | 10/1941 | Peterson | 57/3 X |
| 2,882,676 | 4/1959 | Bryan et al. | 57/293 X |
| 3,017,450 | 1/1962 | Crosby et al. | 57/293 X |
| 3,187,495 | 6/1965 | Cristian | 57/204 X |
| 3,194,873 | 7/1965 | Demmel et al. | 57/204 X |
| 3,847,190 | 11/1974 | Forester | 57/293 X |
| 3,884,025 | 5/1975 | Oberender et al. | 57/293 |
| 4,266,398 | 5/1981 | Vogelsberg | 57/293 |

*Primary Examiner*—Donald Watkins

*Attorney, Agent, or Firm*—David P. Kelley

[57] ABSTRACT

A multi-unit telecommunication cable is disclosed in which the twisted wire pairs of the unit are presented adjacent the conductive cable sheath at irregularly spaced locations. The cable may be made by modulating the amplitude and/or frequency of the oscillations of the faceplate employed in twisting the wire pairs together in forming the cable units.

2 Claims, 12 Drawing Figures

TELECOMMUNICATION CABLES AND METHODS OF MANUFACTURING SAME

TECHNICAL FIELD

This invention relates to telecommunication cables of the type comprised of a number of twisted wire pair or quad units stranded together to form a cable core, and to methods of manufacturing such multi-unit type cables.

BACKGROUND OF THE INVENTION

Telecommunication cables, of the type whereby information is transmitted by conduction of electrical signals, have a cable core comprised of a plurality of twisted wire pairs or quads often hereinafter referred to only as pairs. The core is usually protected by a metallic sheath or shield formed about the core and overlaid with an outer, plastic jacket. Where the cable core contains more than some 10 to 25 individually twisted wire pairs it ordinarily assumes a multi-unit configuration. This is necessitated by structural considerations since a cable core formed of a large number of twisted wire pairs merely massed together is too rigid for cable handling and laying facility. Wire pair identification is also inhibited where a large number of wire pairs are formed into a single unit.

The cores of multi-unit type telecommunication cables are thus formed of several individual, distinct units each comprised of a limited number of twisted wire pairs. Each unit is commonly formed by advancing a group of twisted wire pairs serially through an oscillating faceplate, a sizing die and a binder. The faceplate serves to twist the groups of twisted wire pairs together with a group lay that periodically reverses direction. The sizing die and binder respectively serve to compress the group together and to bind them with a helically wound ribbon or tape. Once the units have themselves been formed they are stranded together and bound with a core wrap to form a finished cable core.

The just described multi-unit type of cable has well served the telecommunications industry now for many years. There has however been one recognized, potentially adverse electrical property associated with their use. However, since it has been outside the audio frequency range, the only range actually carried by the cables until recently, its presence has heretofore been one of acedemic interest only.

Recently, transmission of information has begun to be carried out at higher frequencies as in the transmission of digital data. As a result, what had been a matter of mere academic interest has now become a real, functional problem. The actual problem has to do with insertion loss. Electrical signals transmitted over conductive lines inherently attenuate with distance. For this reason repeaters or regenerators are provided, spaced periodically throughout long routes, to amplify or regenerate the attenuated signal. The magnitude of this attenuation is dependent upon the frequency of the signal transmitted. At lower frequencies the attenuation, or insertion loss as it is termed in the industry, is less than that experienced at higher frequencies. In other words insertion loss is a function of frequency.

When signal strength is plotted against signal frequency a rather smooth curve appears. This, of course, is fortunate since it enables communication system designers to amplify the signals at magnitudes functionally related to the frequency of the signal transmitted. In this manner the strength of the signal received at a reception station, repeater, or regenerator may be equalized, i.e. maintained substantially proportionate to that transmitted over the entire frequency range.

With multi-unit cables the specific problem just discussed rests in the presence of a discrete discontinuity or "notch" in their insertion loss curves. This is exemplified in FIG. 1 wherein a distinct notch 4 is seen to appear in an otherwise smooth insertion loss curve 5 for a multi-unit cable. Since it would be extremely difficult to compensate for this notch with electronic equalizers it becomes necessary to try to prevent its very creation.

Causes of the insertion loss curve notch have been recognized. In multi-unit type cables one such cause is generally attributable to the axial regularity of the appearance of specific wire pairs or quads adjacent to the cable sheath. In other words, the periodicity of the perigee of specific wire pairs in the twisted group forming a unit to the core sheath is regular. This may be better understood by reference to FIGS. 5A–C which schematically illustrate the position of specific wire pairs A through L of a single unit 30 at three axially spaced locations along a cable beneath a tubular metallic cable sheath 31. If in forming the unit the faceplate regularly oscillates through say 340° the A pair will relocate clockwise as illustrated by these sequences until it reaches that location occupied by pair F in FIG. 5A. Then it will reverse and start to occupy other positions on down the line until it reaches that location occupied by pair H in FIG. 5A where it again reverses. Due to the sinusoidal motion of the faceplate oscillation there is a dwell time at each reversal. This causes some wire pairs at twist reversal points to maintain their proximity to the sheath for an extraordinarily long distance. The occurrence of this pair geometry at regular intervals creates impedance changes in these pairs as their electrical field penetrates the metallic sheath. This impedance change causes some of the electrical signal to be reflected back along the cable to provide the insertion loss notch previously mentioned.

With reference to FIGS. 1 and 2 of the drawing the effect of the just described impedance change may be visualized in a somewhat simplified manner. FIG. 2A illustrates a digital pulse train that includes two pulses 2 and 3 which are sufficiently close in time as to fall within the relatively high frequency range of the discontinuity 4 in the insertion loss curve 5. Insomuch as these two bits of data are transmitted at the frequency within the discontinuity 4 these pulses are attenuated to such a degree as to be below the threshold of the signal receiver. This is identified as ERROR in FIG. 2B wherein the amplitude of the signal received is below the threshold level 6. Conversely, the signals derived from the pulses 7 and 8, which are at a lower frequency, are of sufficient magnitude to be beyond threshold. As a result the pulses 7, 8 and 2 received by the receiver are above threshold and thus properly recognized while the pulse 3 is erroneously not recognized.

Efforts have heretofore been made to solve the just described problem through cable redesign. One such prior art approach has been that of having the faceplates, through which the twisted wire pairs are passed to effect unit twisting, oscillate at substantially faster rates. When this is done the interval between twist reversal points becomes shorter which serves to move the discontinuity or notch in the insertion loss curve to a higher frequency level. However, new digital systems often have higher transmission rates which serve to "chase" the notch shift so achieved. Furthermore, higher frequency transmission results in an increase in the number of impedance changes which cumulatively serve to aggravate or deepen the notch. In other words, since the reflection or impedance change caused by the periodic presence of wire pairs is cumulative, the depth of the discontinuity or notch is increased with this approach. In addition, as the frequency of oscillations increase, mechanical limits attributable to inertia are soon reached with the manufacturing equipment employed.

Another approach at solving the problem has been that of making the units of twisted wire pairs into a continuous rather than a periodically reversing lay. This tends to alleviate the mechanical problem associated with quick reversals in faceplate oscillations. However, this approach prevents tandemization of multiple unit formation with that of stranding. Thus, when this process is used the units must be formed in batches to be subsequently stranded into cores.

It therefore is seen that an effective and economic solution for the problem just described yet remains to be had. It is the provision of a solution to this to which the present invention is directed.

SUMMARY OF THE INVENTION

In one form of the invention a method is provided for manufacturing a telecommunication cable having improved insertion loss characteristics. The method comprises the steps of forming a plurality of wire units by advancing groups of twisted wire pairs or quads through twisting stations wherein each group is alternately twisted in clockwise and counter-clockwise rotary directions with either or both the frequency and amplitude of the twisting being modulated. The pluralities of units so formed are then stranded into a cable core and a conductive sheath formed around the core.

In another preferred form of the invention a telecommunication cable is provided having a tubular conductive sheath encircling a cable core comprised of a plurality of elongated units of twisted wire pairs or quads. The wire pairs or quads of each unit are twisted together so as to present each wire pair or quad of each unit adjacent the conductive sheath at irregularly spaced locations along the tubular sheath.

In yet another preferred form of the invention a telecommunications cable is provided having a tubular conductive sheath encircling a cable core. The core is comprised of elongated units of twisted wire pairs or quads. The pairs or quads of each unit are themselves twisted together so as to have oscillation reversal points spaced apart at irregular intervals along the core.

BRIEF DESCRIPTION OF THE DRAWING

FIG. 2A illustrates as a plot of pulse amplitude verses time a digital waveform transmitted over a wire pair in a telecommunication cable. FIG. 2B illustrates the same waveform once it has been propagated along a cable of prior art construction while FIG. 2C illustrates the waveform once it has been propagated along a cable constructed in accordance with the present invention.

DETAILED DESCRIPTION

Figure 1:
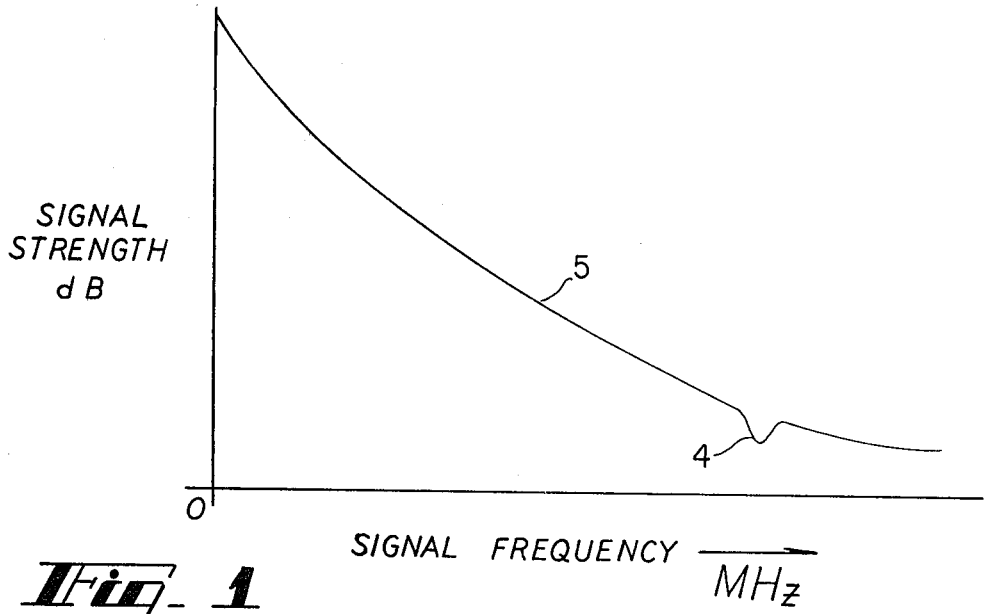
FIG. 1 is a graphic illustration of a discontinuity in the strength of a signal being transmitted over a wire pair in a multi-unit type telecommunications cable over a range of signal frequencies.
Figure 2:
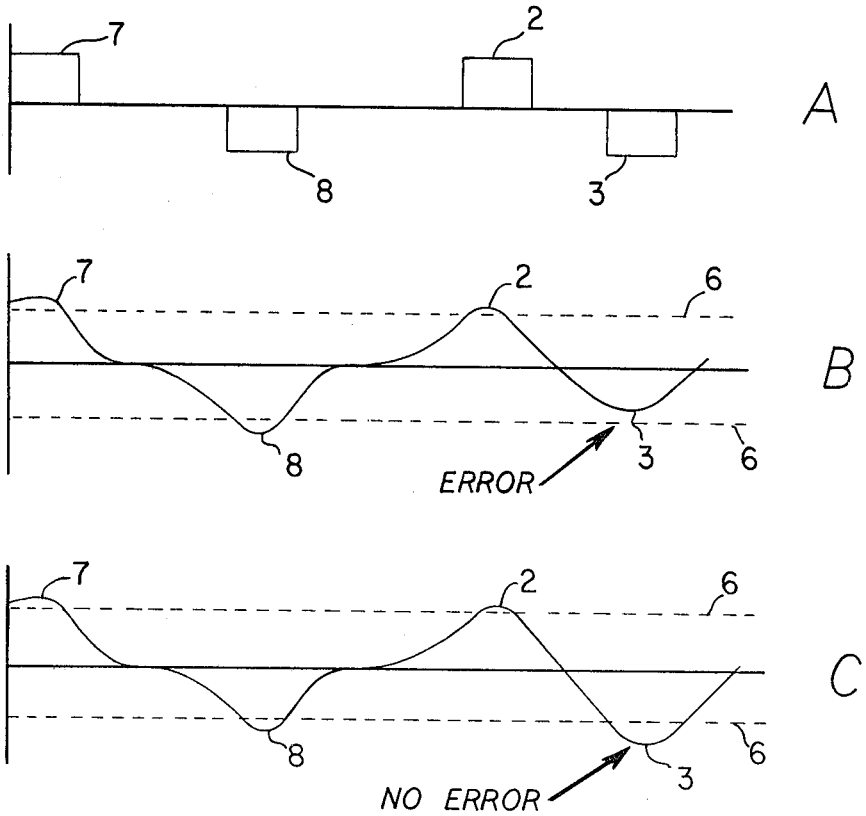
Figure 3:
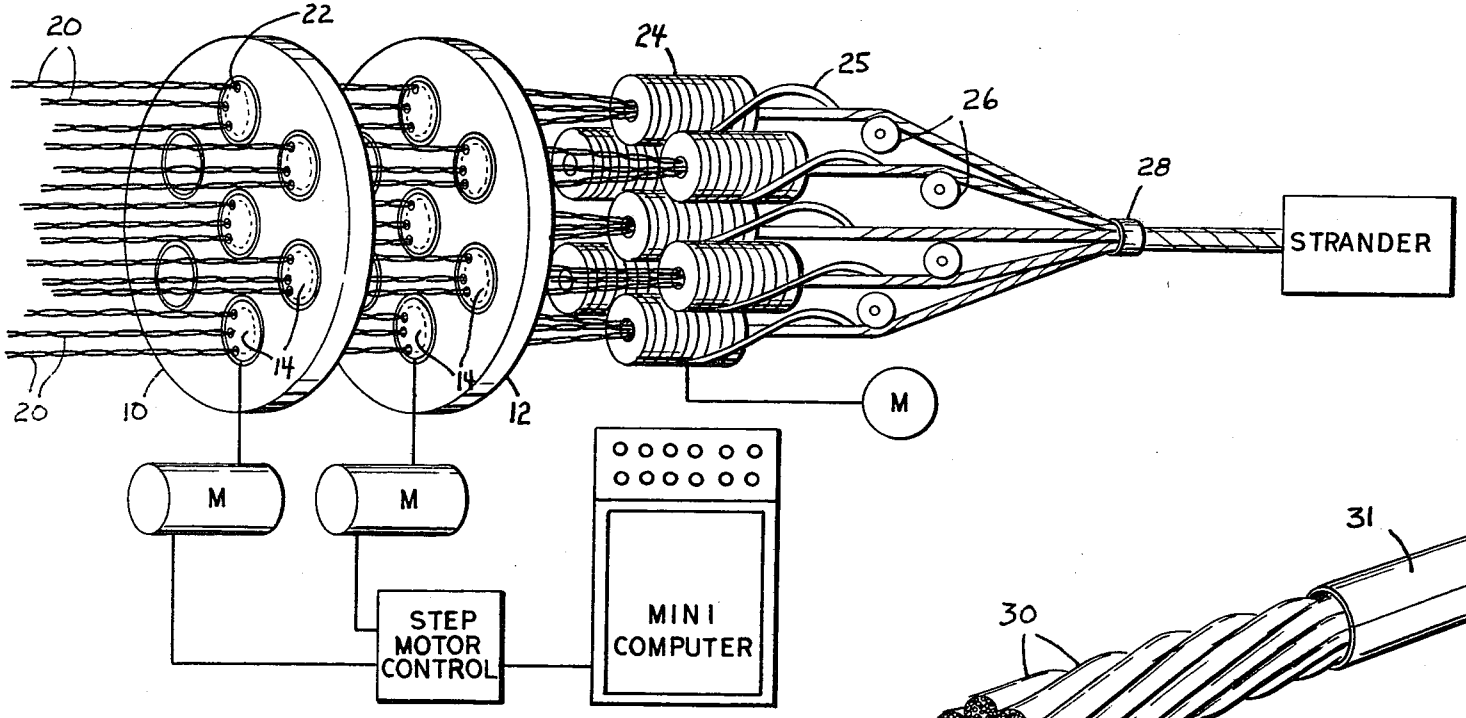
FIG. 3 is a diagrammatical illustration of a telecommunications cable being formed in accordance with principles of the present invention.
Figure 6:
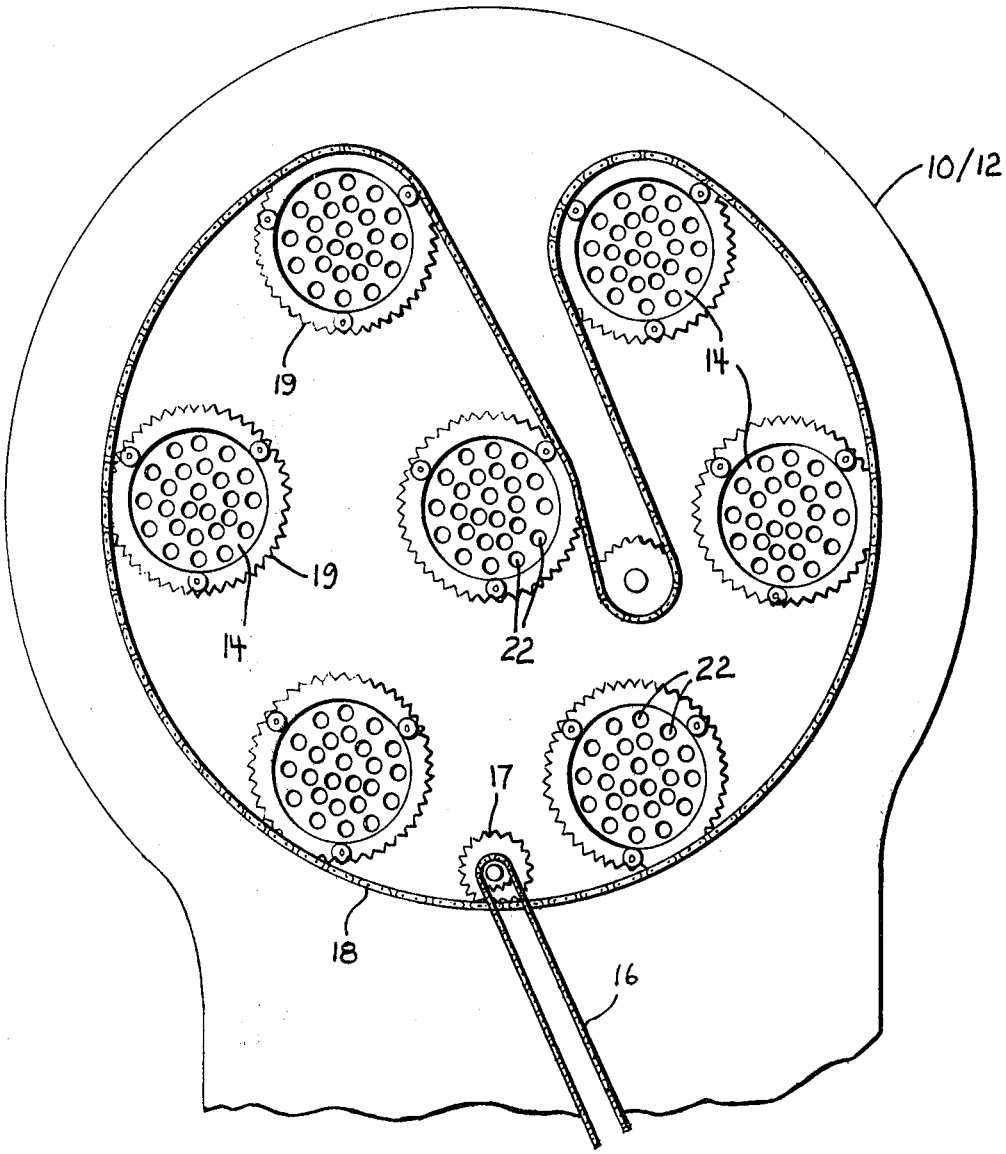
FIG. 6 is a front elevational view of one of the two sets of faceplates illustrated in FIG. 3 utilized in manufacturing telecommunication cable in accordance with the invention.

Referring now in more detail to the drawings, there is shown in FIGS. 3 and 6 apparatus for manufacturing telecommunication cables in accordance with the invention. The apparatus comprises two disc frames 10 and 12 each of which are provided with a set of mutually aligned apertures in which faceplates 14 are rotatably mounted. The faceplates of the disc frames 10 and 12 are each driven by stepping motors M and a power transmission train that includes a chain 16 coupled with a sproket 17 and another endless chain 18 driven by the sprocket 17. The chain 18 drives sprockets 19 that are rigidly secured to each of the faceplates. In this manner the stepping motors M may rotate each of the faceplates simultaneously in the same rotary direction in response to control signals imputted to the stepping motor from a step motor control. A Hewlett Packard Type 2100 Mini-Computer may be conventionally programmed to serve as such a control in conjunction with variable translators.

With continued reference to FIG. 3 it is seen that the twisted wire pairs 20 are routed through aligned apertures 22 in the faceplates and then through bobbins 24. Within the bobbins the several wire pairs passed through each faceplate are brought together and wrapped with binder 25 reeled off of the bobbin. Once bound with binder the formed units are routed over idler rollers 26 through a sizing die 28 and to a conventional strander. The strander serves to twist the individual units together into a complete cable core about which a core binder is wound. A metallic sheath and an outer plastic jacket is subsequently extruded over the core in conventional fashion well known in the cable art. Except for the provision of the stepping motors M, and their associated control, the manufacturing apparatus just described is conventional. A more detailed illustrated explanation of cable stranding may be had by reference to U.S. Pat. No. 2,882,676.

Figure 4:
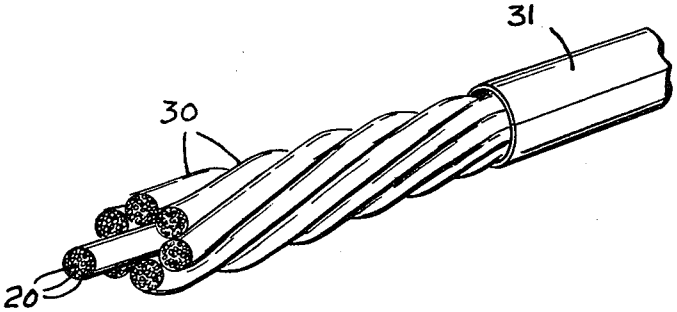
FIG. 4 is a perspective view of a portion of a conventional multi-unit telecommunications cable.

The cable core and sheath structure produced by the just described process is illustrated in FIG. 4 wherein seven individual units 30 are seen to be stranded together and overlayed with a tubular metallic sheath 31. An unshown core wrap is usually wrapped about the units beneath the sheath. Each of the units 30 are seen to be formed of a plurality of the individually twisted wire pairs 20.

In accordance with applicants' invention insertion loss characteristics are improved by modulating the frequency and/or the amplitude of the faceplate oscillations. Frequency modulation causes each twisted wire pair of a unit to be proximal to the core sheath at irregularly spaced intervals. Electrical impedance changes produced by these events are thereby spread irregularly along each notch effected pair. Since this broadens that portion of the insertion loss notch attributable to this, it also diminishes the depth of the notch thereby smoothing the loss curve for the effected pair.

Amplitude modulation produces a somewhat different effect. It serves to bring different wire pairs into position within the faceplates at the time of their reversals in rotary direction. As a result the unusually long pair sections in proximity to the core sheath, inherently attributed to the faceplate dwell time at reversal, are shared by a larger number of wire pairs. Thus, where before some wire pairs would be free of the notch while others would have it, now most all of the pairs share equally in their exposure to the metallic sheath. This has the effect of equalizing the loss among all pairs. By combining the benefits obtained from both amplitude and frequency modulation of the faceplate, distribution in impedance change is effected such as essentially to eliminate the entire problem.

Figure 5A:
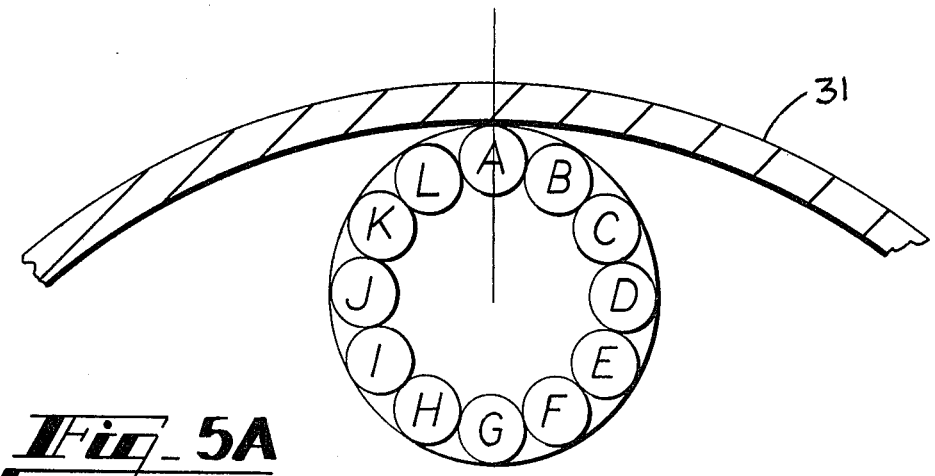
FIGS. 5A–5C schematically illustrate the location of twisted wire pairs or quads of a single cable unit at three different axial locations along a cable.
Figure 5B:
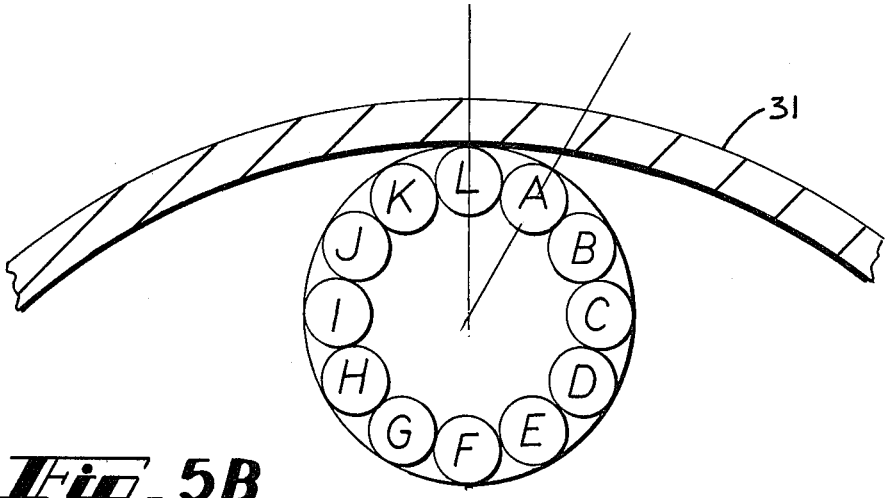
Figure 5C:
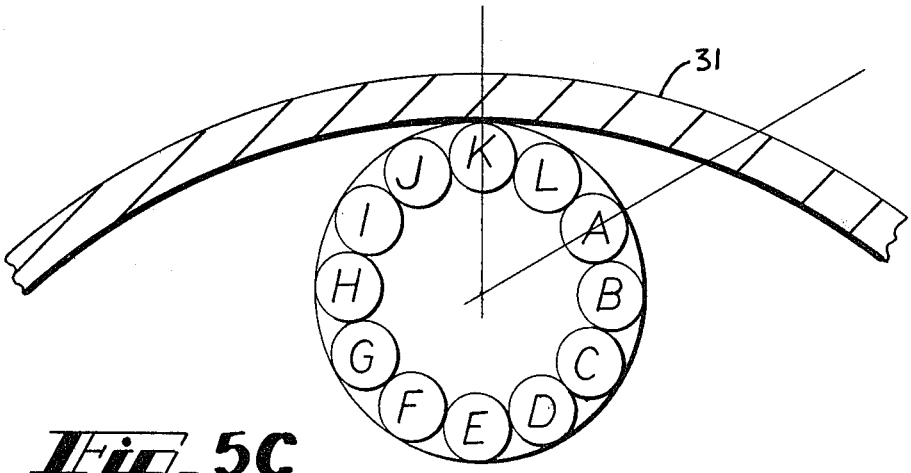

The just described phenomena may be more fully understood by reference once again to FIGS. 5A–5C. In FIG. 5A it is seen that wire pair A of unit 30 is located in proximity to metallic sheath 31. However, since the various wire pairs are themselves twisted together this same pair A will be located in the one o'clock position shown in FIG. 5B at a short distance away on down the core. Still further down the core it will be at the two o'clock position shown in FIG. 5C and so forth. If the faceplate oscillates through 300° the A pair will finally reach the position of pair D in FIG. 5C and then reverse movement to move counterclockwise until it reaches the position occupied by pair F in FIG. 5C where it again reverses. But as previously stated, by modulating the amplitude of faceplate rotation different wire pairs will be within the faceplate at reversal thereby spreading the adverse effects of dwell time among many pairs. By modulating the frequency of faceplate rotation the spacing between proximity or the perigee of each pair to the sheath is made irregular thereby reducing the cumulative effect of the impedance changes there produced.

One preferred function governing faceplate drive is expressed by:

$$\theta(t) = A\left[1 + m_a \sin\frac{2\pi \times (t)}{l_a}\right] \sin\left[\frac{2\pi \times (t)}{l_c} + m_f \sin\frac{2\pi \times (t)}{l_f}\right]$$

where $\theta$ is in degrees, $m_a$ is the amplitude modulation index, $l_a$ is amplitude modulation period, $m_f$ is frequency modulation index and $l_f$ is frequency modulation period. The first term in brackets is the amplitude modulation term while $$m_f \sin\frac{2\pi \times (t)}{l_f}$$

of the second term in brackets is the frequency modulation term. A is amplitude of rotation in degrees, x(t) is the distance along the cable which is the product of line speed and time, and $l_c$ is lay length.

Figure 7:
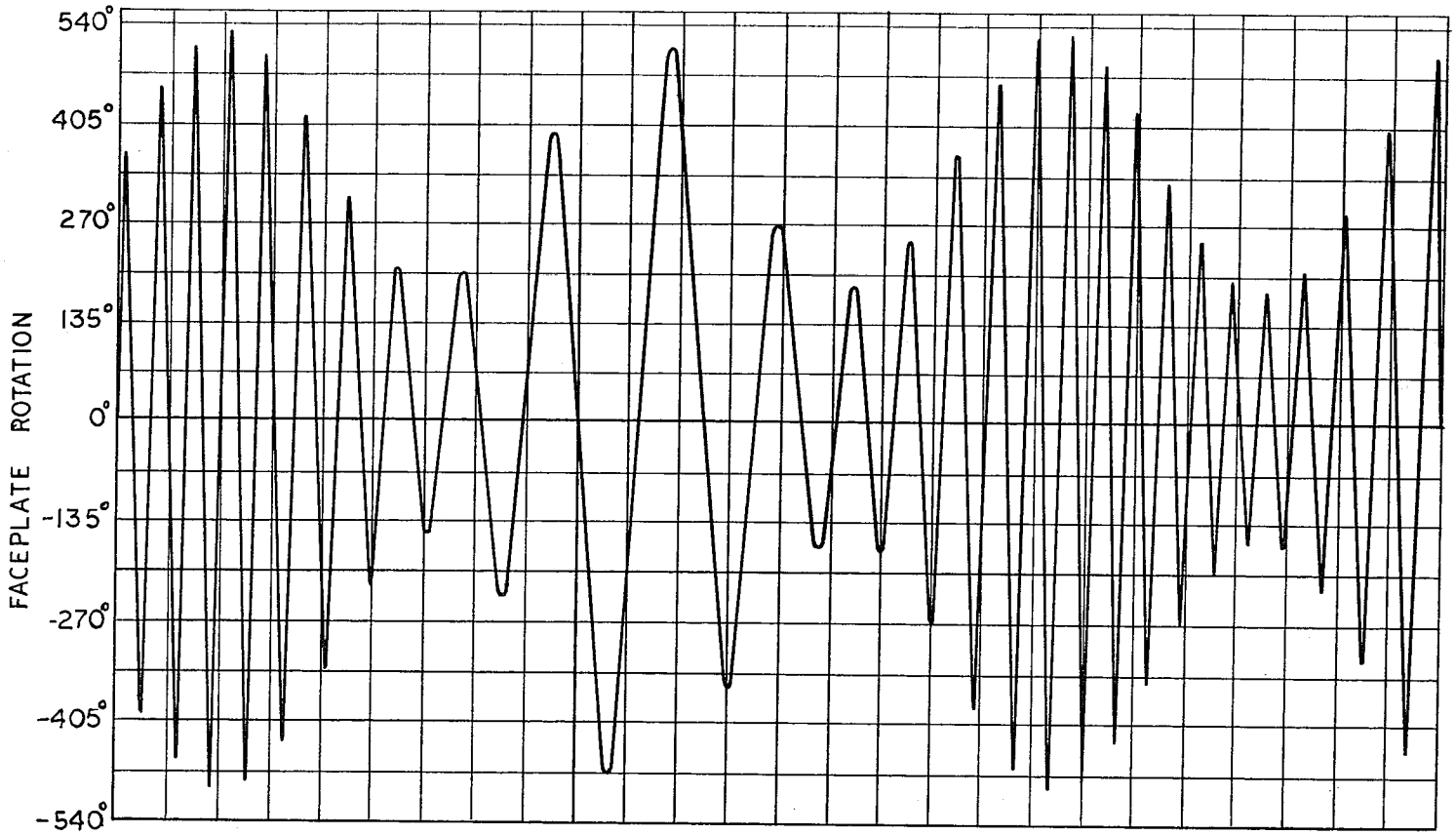
FIG. 7 is a graph of faceplate rotation versus distance along a cable unit conducted in accordance with the present invention in forming twisted wire units.

FIG. 7 illustrates faceplate motion produced for the parameters of $m_a=0.5$; $l_a=400$ feet; $m_f=12.0$; $l_f=1000$ feet; $A=340°$; and $l_c=50$ feet. This resulted in an overall period of 2000 feet at a line speed of 100 feet/minute. The lay length for these values varied from 31.3 feet to 111.6 feet with an average being around 50 feet corresponding to the carrier period. The retained lay is somewhat less than the faceplate rotation and can vary from unit to unit depending on the back tension of the various pairs forming the units and the entrance angles of the pairs into the faceplates.

Figure 8:
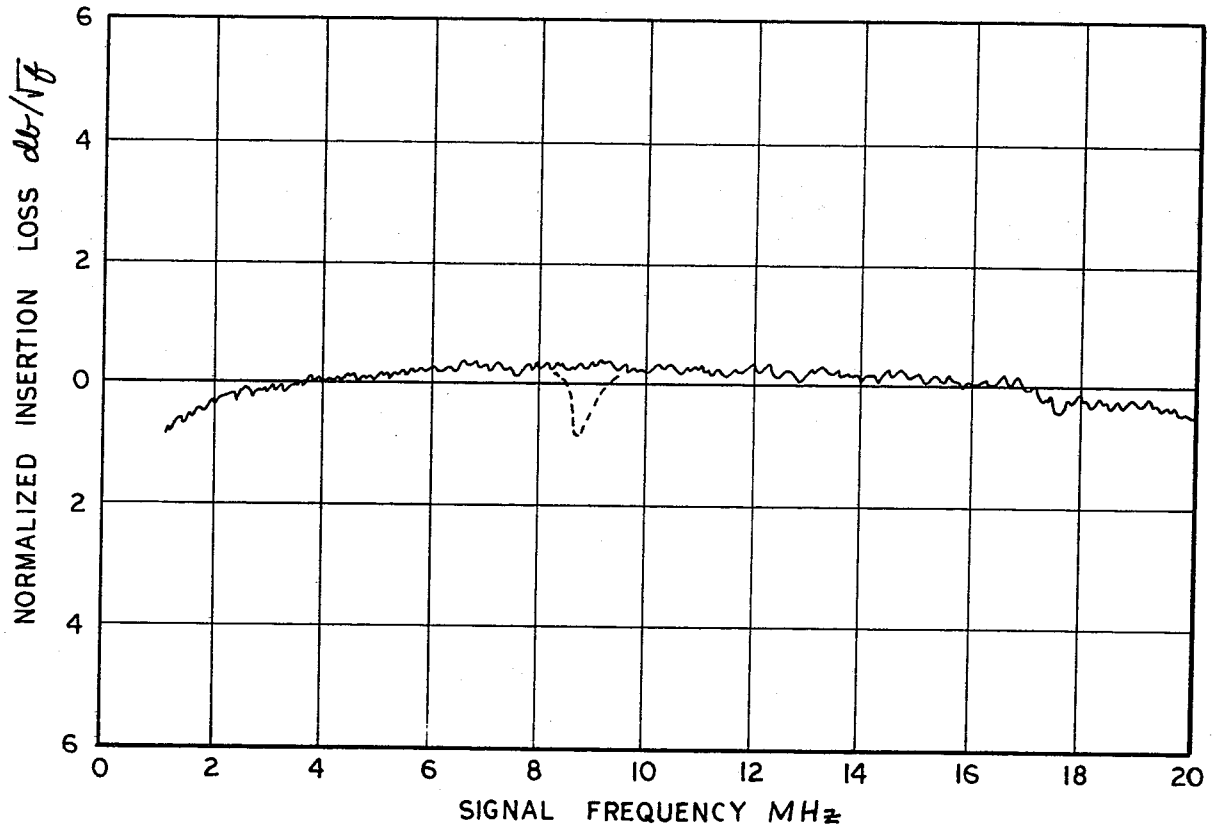
FIG. 8 is a graph of insertion loss versus signal frequency illustrating an improvement in uniformity of loss achieved by the present invention.

FIG. 8 illustrates the improvement achieved by faceplate movement shown in FIG. 7 resulting from the drive produced by the just listed equation parameters. Between 8 and 10 MHz a notch is shown in broken lines empirically measured from a cable of same general construction but formed with regular sinusoidal motion of the faceplates. The solid line, empirically obtained, shows this notch to have been almost totally alleviated.

Wherein the example used an $m_a$ of 0.5 other indices may be used which essentially are mere indications of the degree or amount of modulation employed. However, should the index approach zero obviously the benefit of amplitude modulation has been essentially eliminated. Conversely, should the index approacch unity then significant time periods of no faceplate rotation would be adversely created. The factor $l_a$ is, of course, chosen such that the benefits of the amplitude modulation are achieved, i.e. that the modulation is not spread over so great a length of cable as to be of insufficient value. Similarly, wherein for frequency modulation the above examples used an $m_f$ of 12 again an $m_f$ near zero would eliminate its benefits. Conversely, an excessively large $m_f$ value would produce too wide a range of faceplate oscillation frequency. Other selected values for the factor $l_f$ would also be such as to insure that the frequency modulation occurs sufficiently often as to be effective.

It should be therefore understood that the just described embodiments merely illustrate principles of the invention in selected, preferred forms. Many modifications, additions and deletions other than those expressly mentioned may be made without departure from its spirit and scope as set forth in the following claims.

What is claimed is:

1. A method of manufacturing a telecommunication cable having improved insertion loss characteristics comprising the steps of forming a plurality of wire units by advancing groups of twisted wire pairs or quads through twisting stations wherein each group is alternately twisted in clockwise and counterclockwise rotary directions with both the frequency and amplitude of the twisting being modulated; stranding the plurality of units so formed together into a cable core; and forming a conductive sheath around the core, whereby the cable is manufactured with each wire pair or quad of a unit located proximal to the conductive sheath at irregularly spaced intervals with longer pair or quad sections created by twist reversal dwell time in proximity with the sheath distributed among a relatively large number of wire pairs or quads.

2. A method of manufacturing a telecommunication cable characterized by low insertion loss comprising the steps of forming a plurality of wire units by advancing groups of twisted wire pairs or quads through twister head faceplates while oscillating each faceplate with both the frequency and amplitude of each faceplate oscillation being continuously modulated; stranding the plurality of units so formed together into a cable core; and forming a conductive sheath around the core, whereby the cable is manufactured with each wire pair or quad of a unit located proximal to the conductive sheath at irregularly spaced intervals with longer pair or quad sections created by faceplate dwell time at reversal in proximity with the sheath distributed among a relatively large number of wire pairs or quads.

* * * * *